US006812856B2

(12) United States Patent
Heinz et al.

(10) Patent No.: US 6,812,856 B2
(45) **Date of Patent: *Nov. 2, 2004**

(54) LIGHTED TRAFFIC SIGN ATTACHED TO PORTABLE RESTROOM

(75) Inventors: Richard M. Heinz, Rushville, IL (US); Phillip C. Layne, Rushville, IL (US)

(73) Assignee: Endless Visions, Inc., Rushville, IL (US)

( * ) Notice: Subject to any disclaimer, the term of this patent is extended or adjusted under 35 U.S.C. 154(b) by 34 days.

This patent is subject to a terminal disclaimer.

(21) Appl. No.: 10/241,150

(22) Filed: Sep. 11, 2002

(65) Prior Publication Data

US 2003/0048200 A1 Mar. 13, 2003

Related U.S. Application Data

(60) Provisional application No. 60/318,757, filed on Sep. 12, 2001.

(51) Int. Cl.[7] ..... G08G 1/095

(52) U.S. Cl. ..... 340/907; 340/908; 340/321; 40/606.08; 40/606.18

(58) Field of Search ..... 340/907, 321, 340/332, 908; 40/585, 586, 606.18, 584, 541, 606.03, 606.08, 553, 587, 406, 602, 320; 4/66.2–66.4, 300, 443, 449, 615, 619, 695, 251.1; 248/129; 116/63 P, 63 R

(56) References Cited

U.S. PATENT DOCUMENTS

| | | | | |
|---|---|---|---|---|
| 4,042,919 A | | 8/1977 | Patty | 340/321 |
| 5,276,424 A | | 1/1994 | Hegemann | 340/321 |
| 5,687,500 A | | 11/1997 | Lamparter | 40/572 |
| 5,694,110 A | | 12/1997 | Clifford | 340/321 |
| 6,147,623 A | * | 11/2000 | Rippen | 340/908 |
| 6,150,957 A | | 11/2000 | Henz et al. | 340/908 |
| 6,266,903 B1 | * | 7/2001 | Collins | 40/586 |

* cited by examiner

*Primary Examiner*—Jeffery Hofsass
*Assistant Examiner*—Jennifer Stone
(74) *Attorney, Agent, or Firm*—Husch & Eppenberger, LLC; Robert E. Muir; David A. Chambers

(57) ABSTRACT

An improved lighted traffic sign having an adjustable and portable seat, a portable urinal having an enclosure, a liquid applicator, a hinge, and a sign and warning device is disclosed. The improved lighted traffic sign can be used at the workstation to prevent gaps in traffic control.

29 Claims, 11 Drawing Sheets

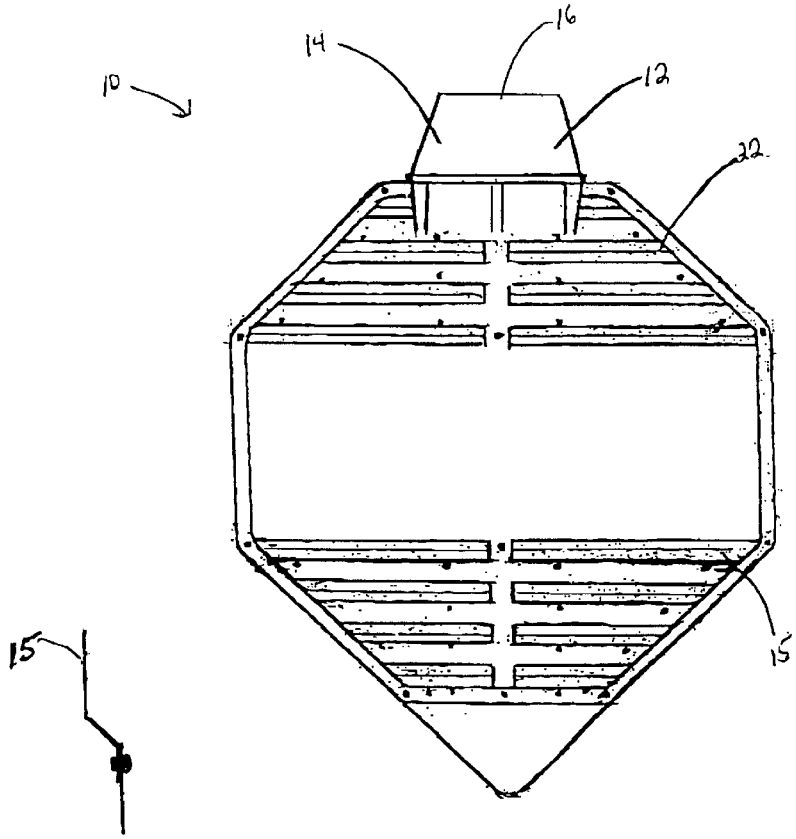
Fig. 1a
Fig. 1b
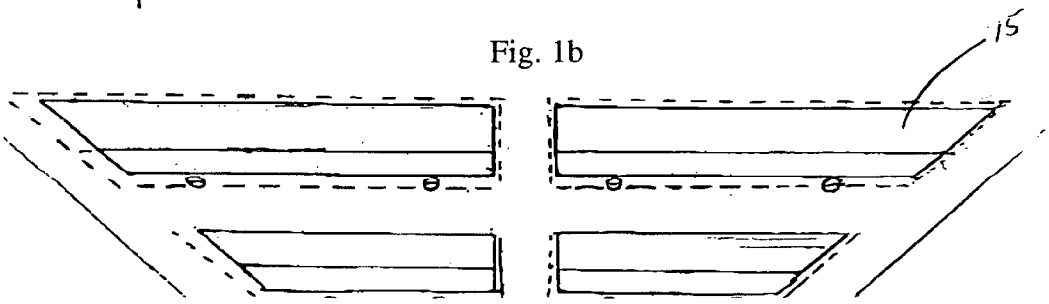

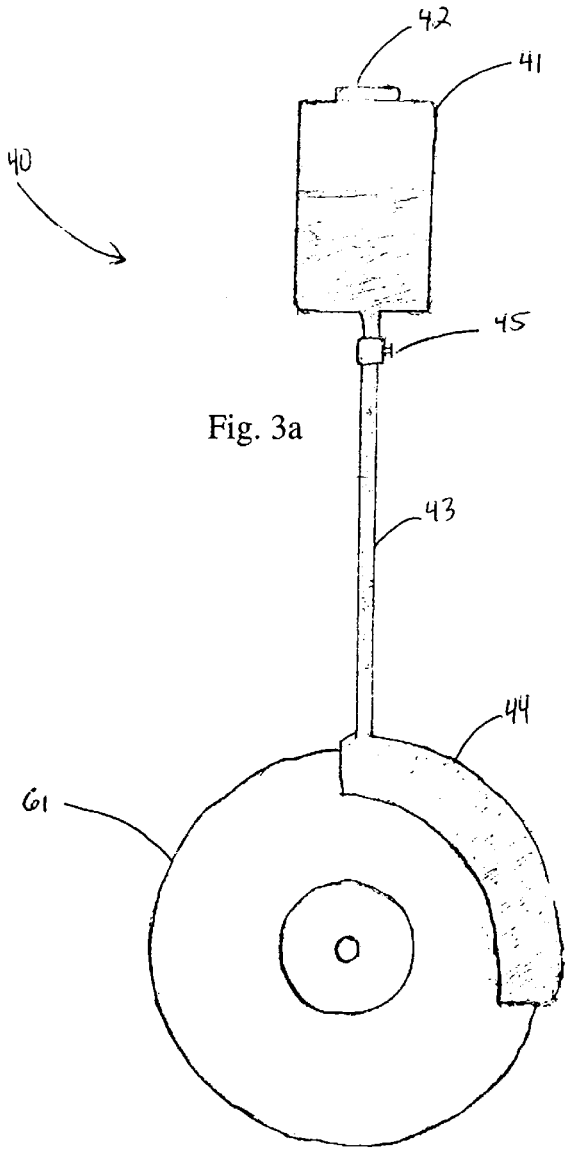
Fig. 3a
Fig. 3b
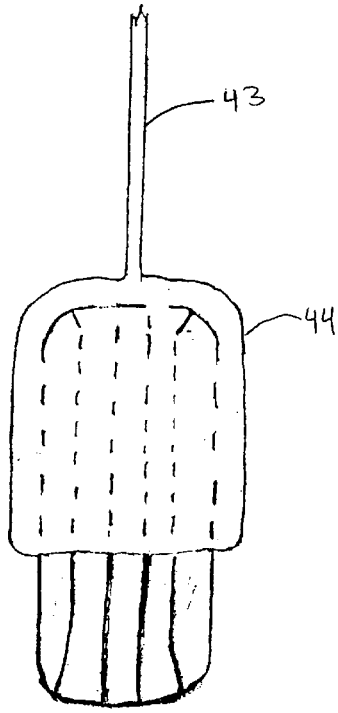

LIGHTED TRAFFIC SIGN ATTACHED TO PORTABLE RESTROOM

CROSS REFERENCE TO RELATED APPLICATIONS

This application claims priority of prior Provisional Application No. 60/318,757 filed on Sep. 12, 2001.

TECHNICAL FIELD OF THE INVENTION

The invention relates to apparatuses for use during traffic control, and more particularly, to an improved lighted traffic sign having an adjustable and portable seat, a portable urinal having an enclosure, a liquid applicator and a sign and warning device for use during controlling traffic.

DESCRIPTION OF THE RELATED ART

Traffic control is very important, especially at construction sites where workers are laboring in close proximity to moving vehicles. As the interstate highway system ages, more repair and construction is being performed at locations where the speed limit is very high. Accordingly, it is important to give motorists warning of the construction area as soon as possible. It is desirable that the warning be visible even under poor visibility conditions. It is also desirable that the warning alert motorists even when there may be other distractions. It is also desirable that the warning device be as versatile and multi-functional as possible. Finally, workers are not free to leave their workstation even in times of personal necessity, so it is important to have devices to accommodate the workers' personal needs at the workstation.

Lighted sign structures are used to warn motorists. The use of lighted sign structures is known in the prior art. Examples include U.S. Pat. No. 6,150,957, issued Nov. 21, 2000, to Heinz et al.; U.S. Pat. No. 4,042,919, issued Aug. 16, 1977, to Patty; U.S. Pat. No. 5,276,424, issued Jan. 4, 1994, to Hegemann; U.S. Pat. No. 5,694,110, issued Dec. 2, 1997, to Clifford; and U.S. Pat. No. 5,687,500, issued Nov. 18, 1997, to Lamparter. The first is a lighted sign and warning device. The next three are hand-held signs and, as such, their battery capacity is limited. The last is mounted on a school bus and uses the bus' power supply; however, it is not usable at a construction site.

The problem with many of these devices is that they do not allow wind to pass through the sign, which is difficult to handle during windy conditions. The Heinz Patent allows wind to pass through the sign, but during sunny days, the light shines through making it difficult for motorists to read the sign.

The workers using these signs and warning devices for controlling traffic are not free to leave their workstation even in times of personal necessity. For example, a worker is not allowed to leave a traffic control sign unmanned to use the restroom. The consequences of an unmanned traffic control sign could be devastating.

The present invention is directed to overcoming one or more of the problems set forth above.

SUMMARY OF THE INVENTION

An aspect of the present invention is to provide apparatuses for use during traffic control which overcome one or more of the above described deficiencies.

In another aspect of the invention, there is provided a sign and warning apparatus for controlling traffic having slots and inserts therein to allow wind to pass through the sign and warning apparatus while precluding light from passing through.

In another aspect of the invention, there is provided a seat apparatus for a person to rest or lean against during long periods of standing.

In yet another aspect of the invention, there is provided an applicator for applying liquid to wheels or tires of a device to preclude the accumulation of asphalt, tar or other matter during movement in construction.

In still another aspect of the invention, there is provided a portable restroom apparatus for use while simultaneously controlling traffic so that the worker does not have to leave the workstation.

In yet another aspect of the invention, there is provided a restroom enclosure apparatus for use with the portable restroom apparatus to provide privacy.

The above aspects are merely illustrative examples of a few of the innumerable aspects associated with the present invention and should not be deemed an all-inclusive listing in any manner whatsoever.

BRIEF DESCRIPTION OF THE DRAWINGS

Reference is now made to the drawings which illustrate the best known mode for the apparatuses; and wherein similar reference characters indicate the same parts throughout the several views.

FIG. 1 is a cross-sectional side view of a sign and warning apparatus for controlling traffic having slots and inserts thereon to allow wind to pass through the sign while precluding light from passing through;

FIG. 1*a* is a front view of a sign and warning apparatus for controlling traffic having slots and inserts thereon to allow wind to pass through the sign while precluding light from passing through;

FIG. 1*b* is an enlarged front view of the inserts shown in FIGS. 1 and 1*a* of the sign and warning apparatus for controlling traffic having slots and inserts thereon to allow wind to pass through while precluding light from passing through;

FIG. 3*a* is a side view of an applicator for applying liquid to wheels or tires of a device to preclude the accumulation of asphalt, tar or other matter during movement in construction;

FIG. 3*b* is an end view of an applicator for applying liquid to wheels or tires of a device to preclude the accumulation of asphalt, tar or other matter during construction;

DETAILED DESCRIPTION

Figure 1:
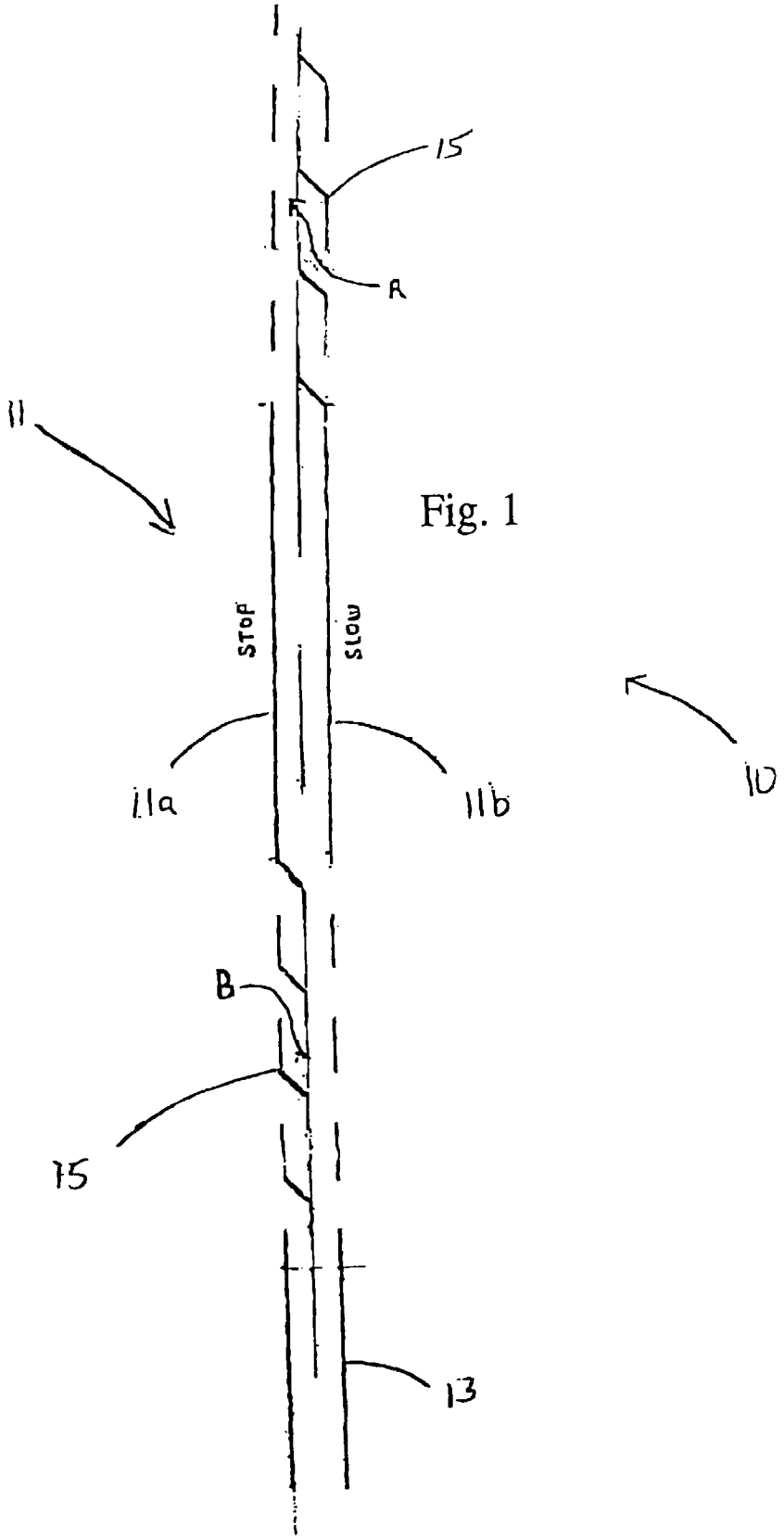

FIGS. 1, 1*a*, and 1*b* illustrate a sign and warning device 10 used to warn approaching motorists to areas of construction or repair. The sign and warning device 10 is an improvement of U.S. Pat. No. 6,150,957, which is hereby incorporated by reference.

The sign and warning device 10 includes a two-faced sign 11 supported on an extendable telescoping pole 13, and a high intensity quad flashing strobe light 12 encased in an omnidirectional housing 14. The two-faced sign 11 can be removed from the extendable telescoping pole 13. The housing 14 contains a metal plate 16, which reflects the strobe light outwardly and downwardly. The light is reflected outwardly to project the light at a great distance to alert motorists and oncoming traffic. The light is reflected downwardly to illuminate the face of the two-faced sign 11 which helps to call attention to it and to make it more recognizable and readable. Moreover, the light is reflected outwardly and downwardly to provide a work light at night. The housing 14 is mounted at the top of the two-faced sign 11 and the light 12 is plugged into a receptacle (not shown) to connect it to DC power. This upper receptacle is connected to a receptacle (not shown) near the bottom of the extendable telescoping pole 13 by a spiral electrical cord which is enclosed in the extendable telescoping pole 13. A battery (not shown), advantageously a rechargeable 12 volt, 600 amp., deep cycle marine-type battery, is connected by a wire with an electrical plug (not shown) to this receptacle (not shown), thus providing power for the light.

The two-faced sign 11 is formed by two vented octagonal sheets 11*a*, 11*b* which are joined by a plurality of ¾ inch nylon spacers (not shown). Typically one sheet has one message or indicia, such as "STOP," and the other sheet has another, such as "SLOW." The sheets 11*a*, 11*b* have slots 22, which are advantageously horizontal as shown in FIG. 1*a*. The purpose of the slots 22 is to decrease wind resistance. The slots 22 have inserts 15 that are positioned such that a horizontal viewing line is blocked. The inserts 15 can be of various configurations; however, in the preferred embodiment, the inserts 15 are substantially "z" shaped. The inserts 15 can be made out of the sheets of metal that are cut to make the slots 22. For example, the material removed can be bent or formed to make the inserts 15. The inserts 15 may also be plastic and manufactured using an injection molding technique. The inserts 15 are placed between the two-faced sign 11 and attached thereto. In the preferred embodiment, the inserts 15 are riveted; however, there are many fastener means known to those skilled in the art that can substituted for the rivets. The slots 22 allow wind to pass through the two-faced sign 11, while the inserts 15 preclude sun light from passing directly horizontal through the two-faced sign 11. The inserts 15 assist motorist by blocking sun light that shines through the slots 22 impairing their ability to read the sign. The inserts 15 above the message or indicia are mounted such that the wind passes upwardly as shown in FIG. 1 by arrow A. Conversely, the inserts 15 below the message or indicia are mounted such that the wind passes downwardly as shown in FIG. 1 by arrow B. The slots 22 decrease wind resistance, while the inserts 15 preclude sun light from shining directly horizontal through the slots 22. This combination is beneficial.

Figure 2:
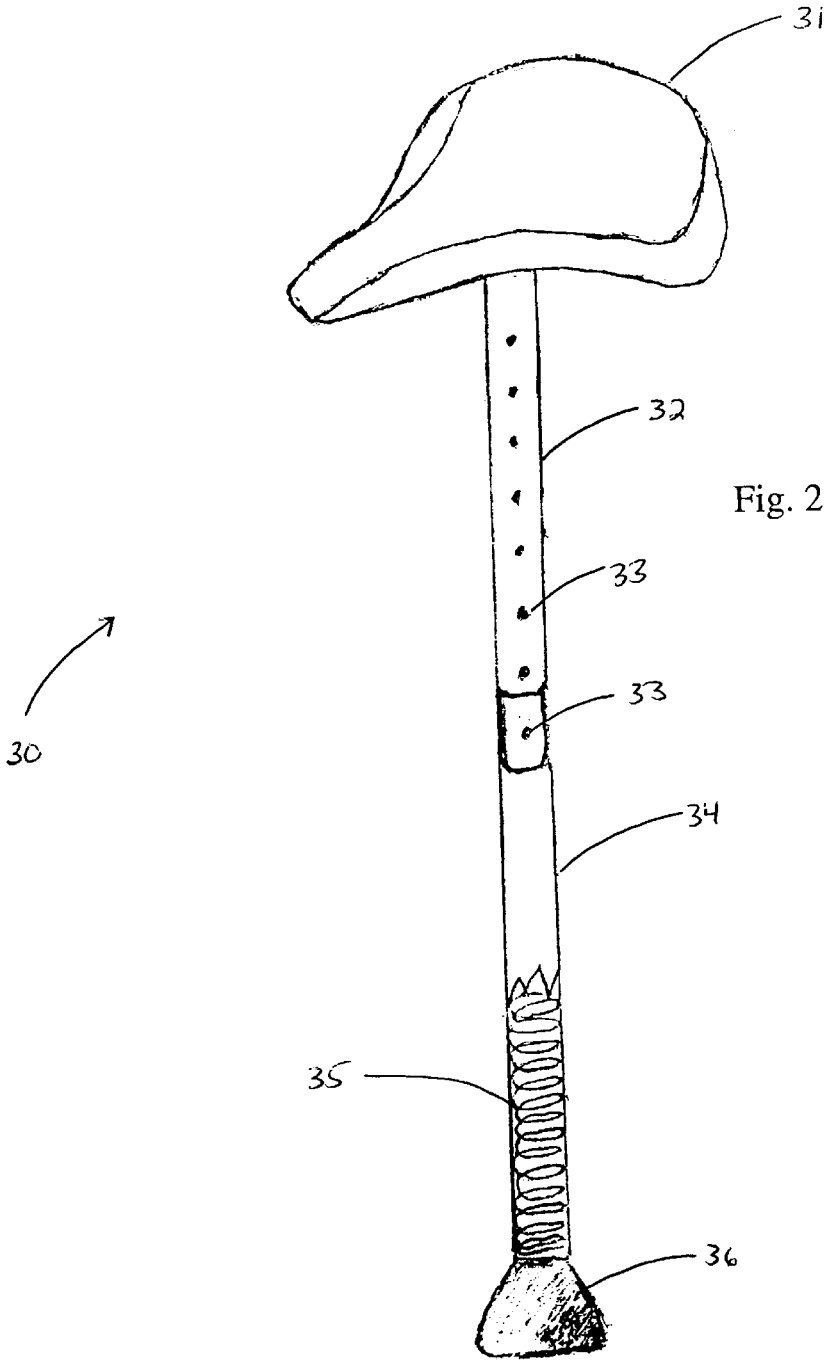
FIG. 2 is a perspective view of a seat apparatus for resting on or leaning against during long periods of standing.
Figure 2A:
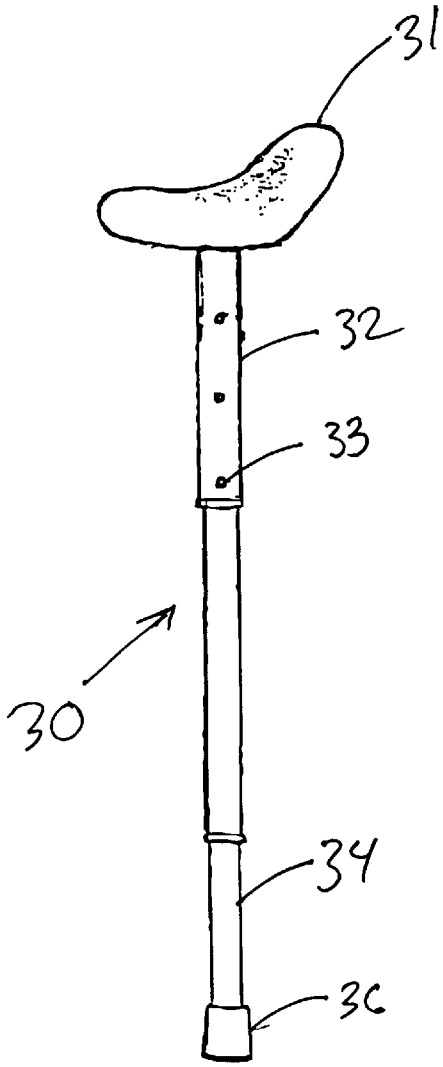
FIG. 2*a* is a side view of a seat apparatus for resting on or leaning against during long periods of standing.
Figure 2B:
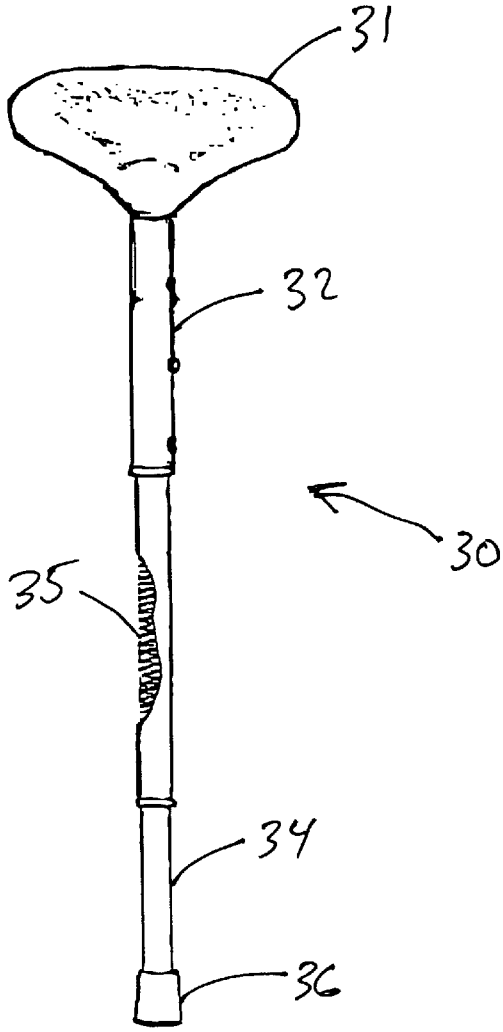
FIG. 2*b* is a front view of a seat apparatus for resting on or leaning against during long periods of standing.

Referring now to FIGS. 2, 2*a*, and 2*b*, an adjustable, portable seat device 30 having a seat 31 is illustrated. The seat 31 is similar to a bicycle seat in the preferred embodiment; however, there are various seat designs that can be substituted. The seat 31 is operatively attached to a bar 32 having holes 33 for receiving a pin (not shown). The bar 32 slips around or between a lower bar 34 having holes 33 for receiving a pin (not shown). The bar 32 and the lower bar 34 mate such that the holes 33 align in at least one place. The pin is placed through the holes 33 in the bar 32 and the lower bar 34, thereby setting the height of the seat 31. The lower bar 34 has a resilient means 35 operatively attached thereto. In a preferred embodiment, the resilient means is a spring, but it may also be a pneumatic, hydraulic or gas-charged shock absorber. The resilient means 35 reduces the rigidity of the seat device 30 for comfort. The lower bar 34 has a non-skid pad 36, which is preferably made of rubber. The non-skid pad 36 provides a non-slip surface between the seat device 30 and the ground or resting surface.

The seat device 30 can be used by people that stand for long periods of time to take stress off of the lower back and feet. In one example, construction or traffic workers utilize the seat device 30 while controlling traffic. The desired height is ascertained and set by aligning the holes 33 of the bar 32 and the lower bar 34 and placing the pin through the holes 33. The worker leans against the seat device 30 to take the stress off of the lower back. The resilient means 35 provides comfort to the worker. The worker is able to hold a traffic control sign or control mechanism for an automated traffic control sign while leaning or resting against the seat device 30. Moreover, the worker can quickly move away from the seat device 30 in case of an emergency. For example, if a car is coming towards the worker, the worker may instantly stop leaning against the seat device 30 and rapidly move out of the way. In contrast, if a car is moving towards the worker sitting on a chair or stool, the worker would first have to stand up. The additional time to stand may mean the difference between injury and well-being.

Referring now to FIGS. 3, 3*a*, 3*b*, and 3*c*, a liquid applicator device 40 is shown having a reservoir 41 for storing liquids. The reservoir 41 has a cap or opening 42 for receiving liquids. The liquid applicator device 40 is used in conjunction with the sign and warning device 10 described above or for similar sign and warning devices known to those skilled in the art in conjunction with a base 60, shown best in FIG. 5*a*. The base 60 is similar to the one described in U.S. Pat. No. 6,150,957, which was previously incorporated by reference and no further explanation is therefore required. The base 60 has wheels 61, which are preferably rubber. The reservoir 41 is located above the wheels 61. A line 43 operatively connects the reservoir 41 to a removable applicator pad 44 mounted partially around the diameter of the wheels 61. The line 43 transfers the liquid from the reservoir 41 to the applicator pad 44. The applicator pad 44 may be removed when not needed, such as when the sign and warning device 10 is used in general road construction.

A valve 45 is operatively connected between the reservoir 41 and the applicator pad 44 for controlling the flow of liquid from the reservoir 41. The valve 45 is adjustable to regulate the flow of liquid from the reservoir 41 and can be completely opened or closed as the case may be.

Figure 3:
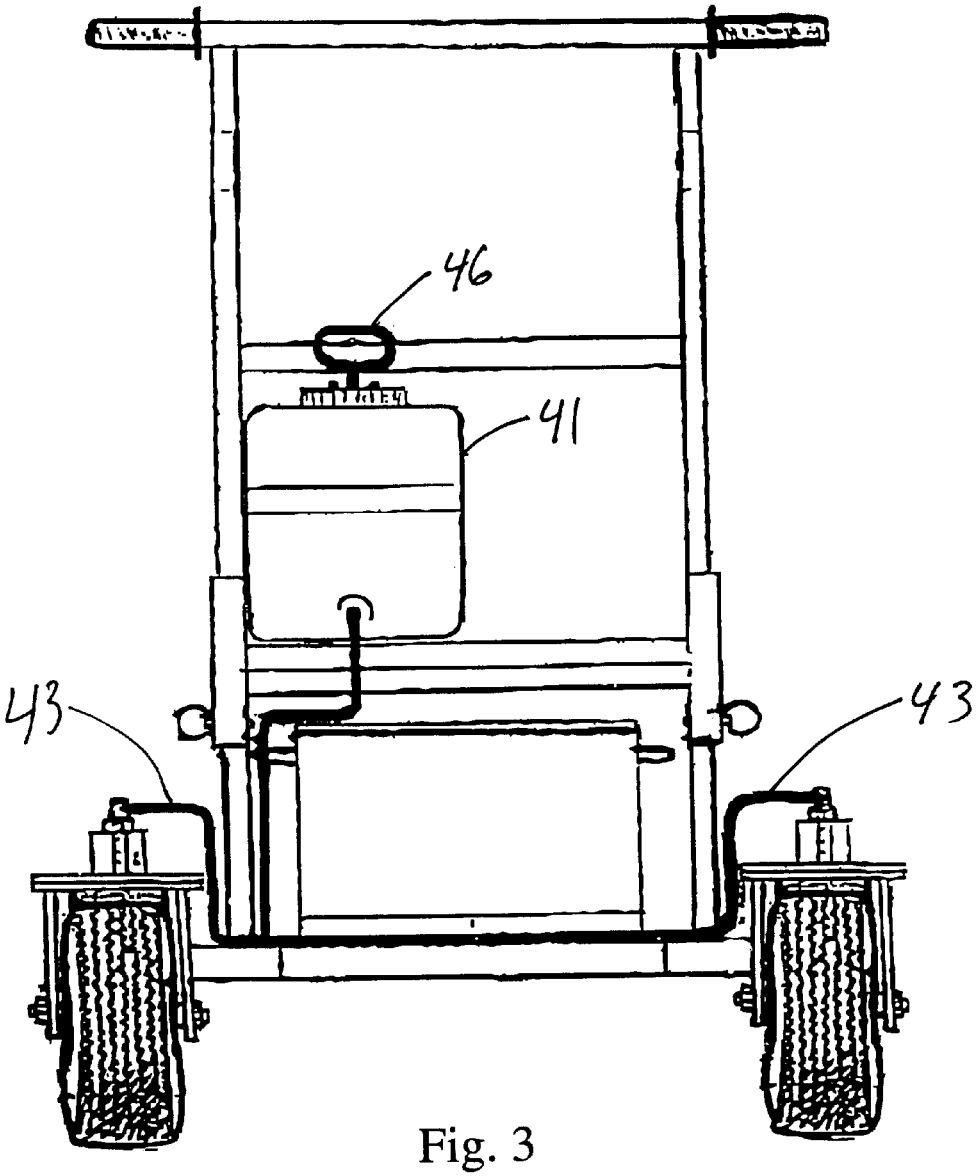
FIG. 3 is an end view of an applicator for applying liquid to wheels or tires of a device to preclude the accumulation of asphalt, tar or other matter during construction.

The reservoir 41 is filled with linseed oil, citrus plus, terpene or other liquids that preclude asphalt, tar or other material from accumulating on the wheels 61 of the base 60 when the base 60 is moved from one location to another. In a preferred embodiment, the liquid from the reservoir 41 flows downwardly to the applicator pad 44 due to gravity. In another embodiment, the liquid is transferred from the reservoir 41 to the applicator pad 44 through means of a pump 46. The pump 46 can be mechanical or electrical. In FIG. 3, a mechanical hand pump 46 is shown.

Figure 3C:
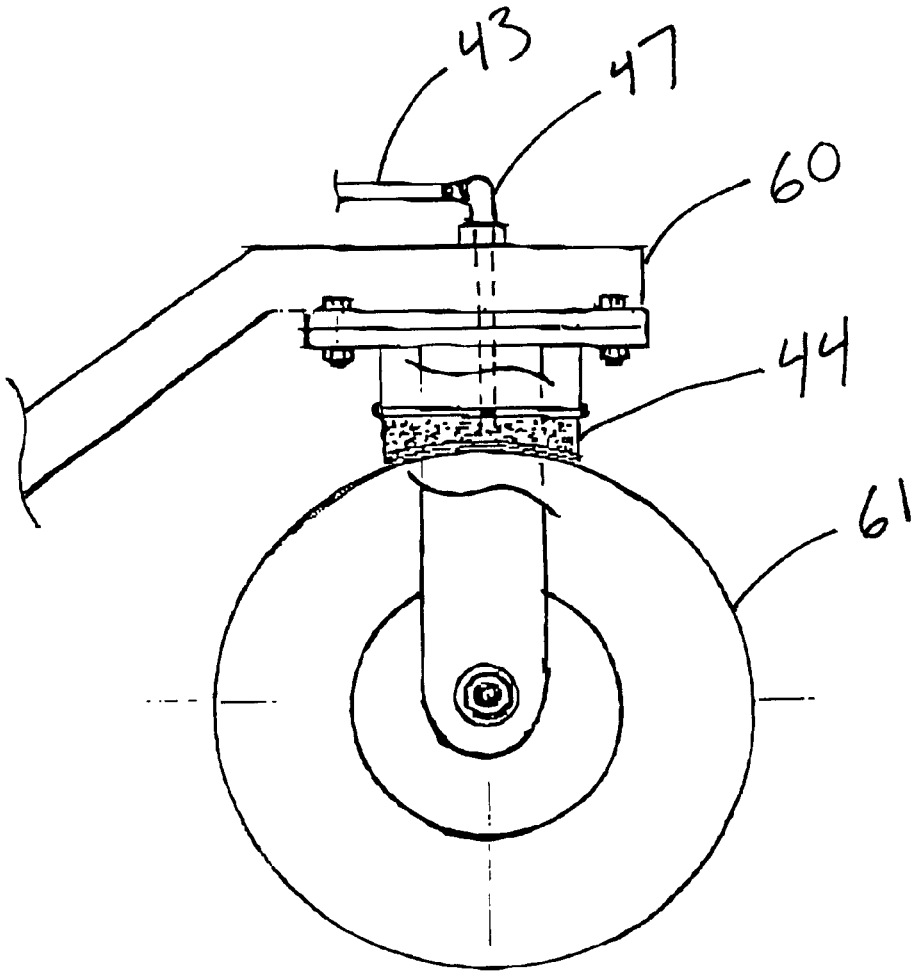
FIG. 3*c* is an end view of an applicator for applying liquid to wheels or tires of a device to preclude the accumulation of asphalt, tar or other matter during construction.

FIG. 3*c* illustrates an embodiment where the wheels 61 are pivotally mounted on the base 60. The line 43 is operatively connected to a fitting 47. The fitting 47 is operatively connected to the base 60. The base 60 includes a hole so that the liquid may pass from the line 43 through the fitting 47 and the base 60 to the applicator pad 44.

Figure 4:
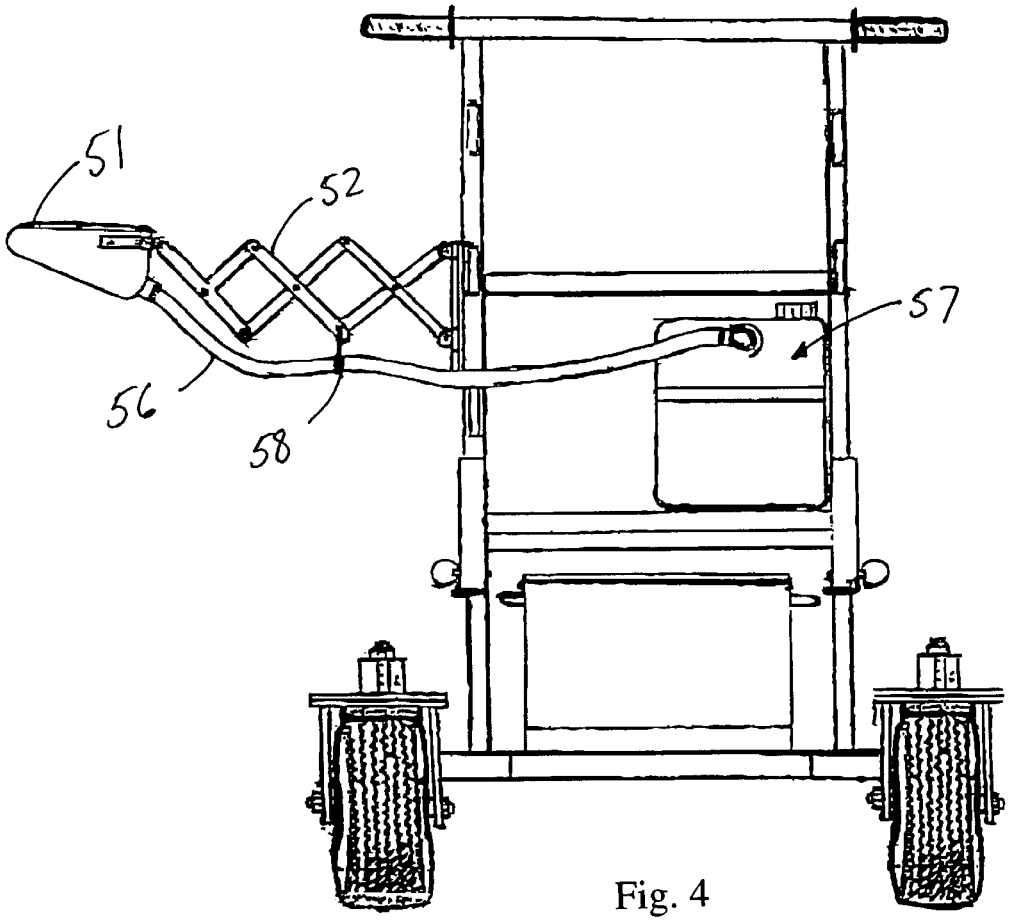
FIG. 4 is a side view of a portable restroom apparatus for use while controlling traffic so that the worker does not have to leave the workstation.
Figure 4A:
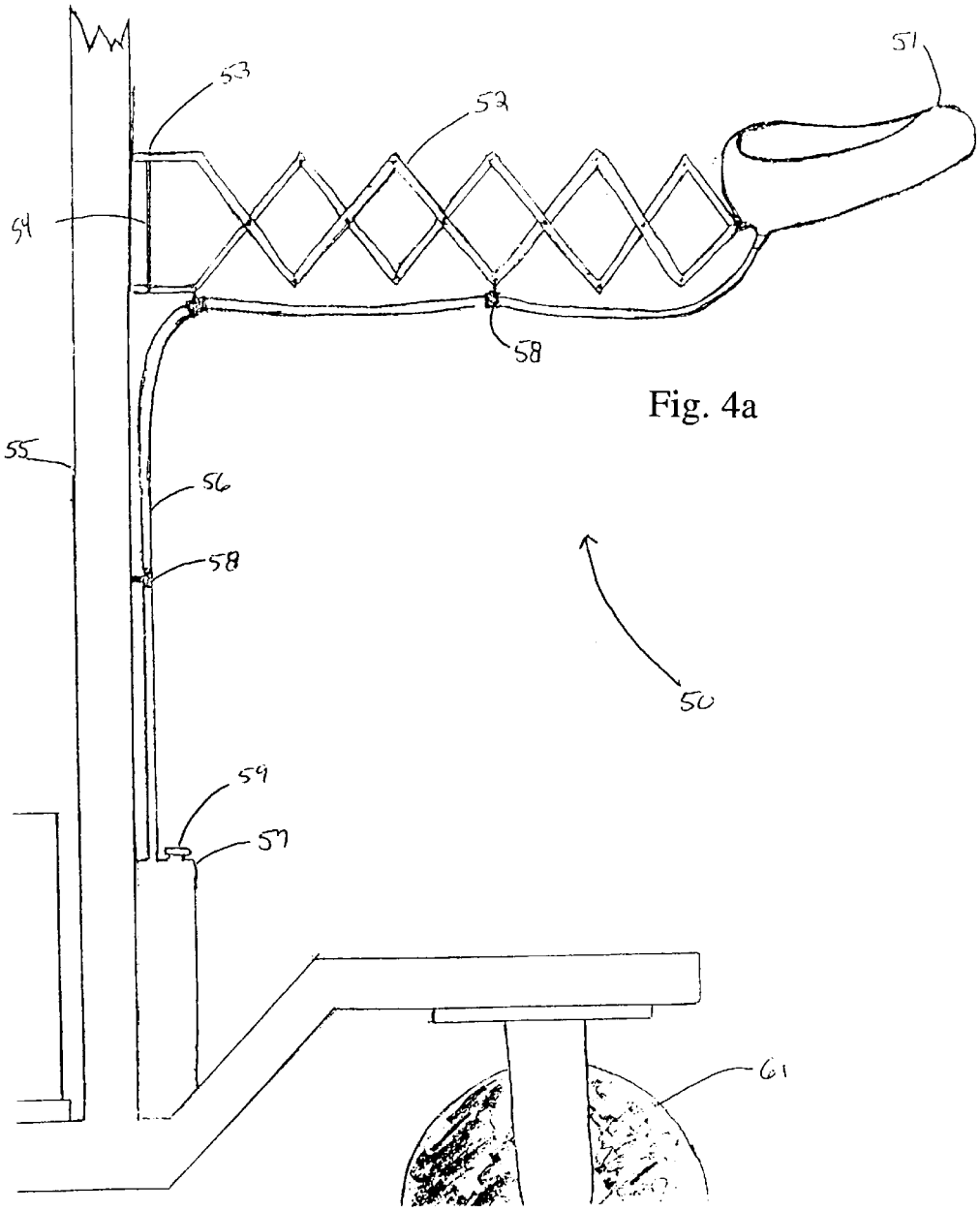
FIG. 4*a* is an enlarged side view of a portable restroom apparatus for use while controlling traffic so that the worker does not have to leave the workstation.

FIGS. 4 and 4*a* shows a portable restroom facility 50 having a urinal 51 for receiving urine. The urinal 51 is operatively attached to an extension device 52. The extension device 52 is operatively attached to a swivel 53. The extension device 52 can be extended as shown in FIG. 4*a* or retracted toward the swivel 53. The swivel 53 is used to pivot the extension device 52 and the urinal 51 about an axle 54 of the swivel 53. The extension device 52 and the swivel 53 is operatively attached to a frame 55 of the base 60.

The urinal 51 has a tube 56 operatively attached thereto, wherein urine is received in the urinal 51 and flows through the tube 56 to a waste tank 57. The tube 56 is attached to the extension device 52 and the frame 55 by fasteners 58. The waste tank 57 receives and stores the urine received from the tube 56. The waste tank 57 is removably mounted to the frame 55 so that it can be removed and emptied at convenient times by removing a waste cap 59.

Figure 5C:
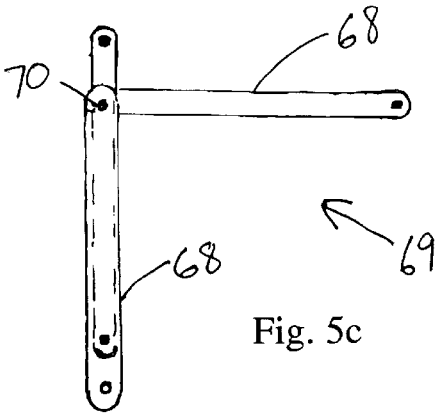
FIG. 5*c* is a top view of two arms of the frame shown in FIG. 5*b* for the restroom enclosure apparatus shown in FIG. 5*a* for use with the portable restroom apparatus shown in FIG. 4 to provide privacy, illustrating how the arms of the frame are folded in during non-use.
Figure 5A:
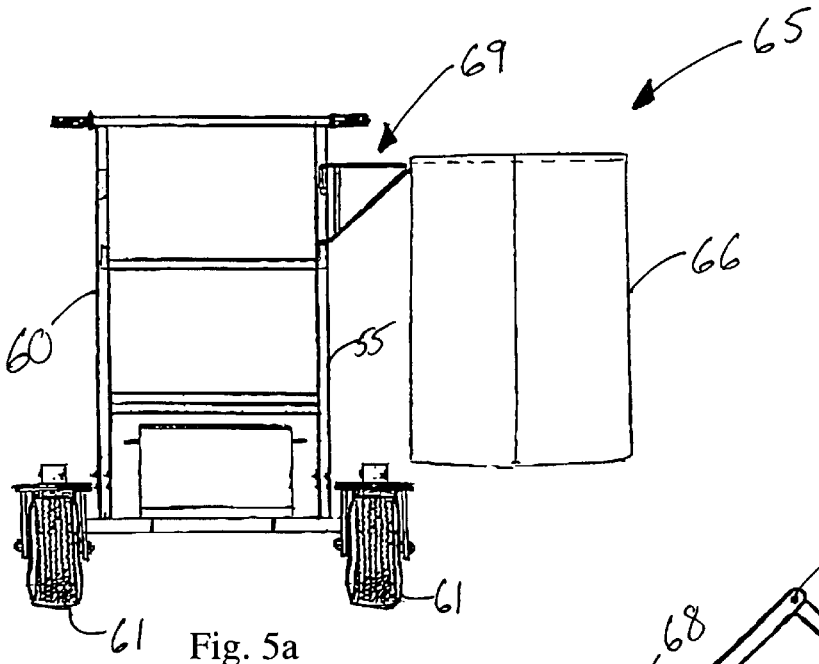
FIG. 5*a* is an end view of a restroom enclosure apparatus for use with the portable restroom apparatus shown in FIG. 4 to provide privacy.
Figure 5B:
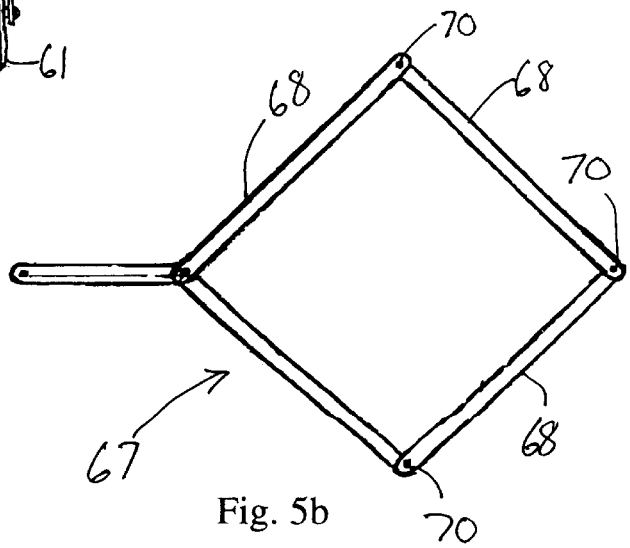
FIG. 5*b* is a top view of a frame for the restroom enclosure apparatus shown in FIG. 5*a* for use with the portable restroom apparatus shown in FIG. 4 to provide privacy.

FIG. 5*a* shows the base 60 having the pole 13, which is attached to the two-faced sign 11 or other sign. A restroom enclosure 65 is provided having a curtain 66. The curtain 66 is operatively attached to an extension frame 67. The extension frame 67 has arms 68, preferably four as shown in FIG. 5*b*. The arms 68 are operatively connected together by pins 70. In the preferred embodiment, one of the pins 70 is removable so that the arms 68 can be folded as shown in FIG. 5*c* during non-use. The extension frame 67 is operatively attached to a height adjustment or raising/lowering device 69. The height adjustment device 69 is used to lower and raise the extension frame 67 and the curtain 66 to a desired height while a person uses the portable restroom facility 50 shown in FIG. 4 and described above. The height adjustment device 69 can be made from various designs; however, in the preferred embodiment, a triangular shaped bracket slides up and down a pin. These types of devices are known to those skilled in the art and no further explanation is required.

Referring in jointly to FIGS. 4, 5*a*, 5*b* and 5*c* for operational purposes, a person in need of urinating pulls the extension device 52 outwardly, horizontally away from the base 60. The person positions himself in front of the urinal 51 and thereafter positions the extension frame 67 around his body fastening the pin 70. The curtain 66 is positioned around the person and the height of the height adjustment device 69 is adjusted to the appropriate height. Thereafter, the person has privacy during urination. During times when a person cannot be found to replace another person controlling traffic, the person controlling traffic can simultaneously use the portable restroom facility 50 and control traffic by holding the sign. Alternatively, the person does not have to leave the workstation to use a remote restroom and can use the portable restroom facility 50 during non-active times. The portable restroom facility 50 and the restroom enclosure 65 are ideal when a person is not able to leave the workstation.

After use, the extension frame 67 is folded up as shown in FIG. 5*c* by removing the pin 70. The extension device 52 is pushed inwardly towards the base 60. The waste tank 57 can be emptied at a convenient time.

Figure 6A:
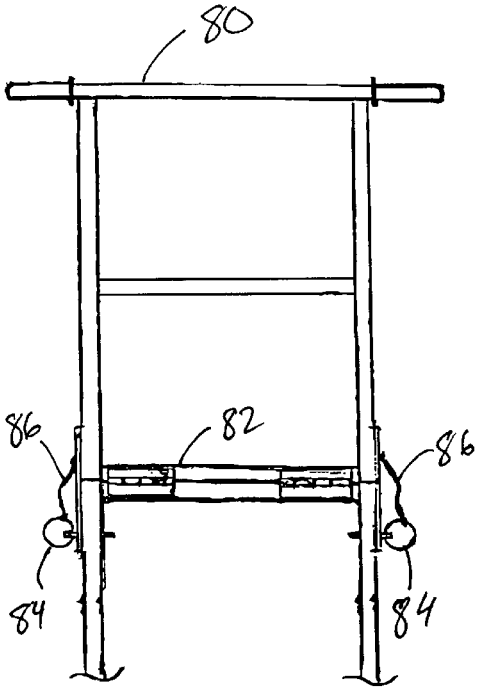
FIG. 6*a* is a front view of a hinge system incorporated into a push bar handle.
Figure 6B:
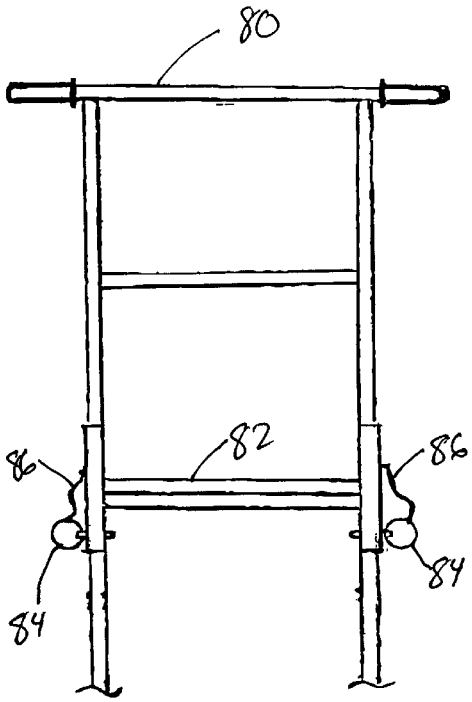
FIG. 6*b* is a back view of a hinge system incorporated into a push bar handle.

Referring now to FIGS. 6*a* and 6*b*, a push bar handle 80 can be incorporated into the device, which was incorporated by reference. The push bar handle 80 can be improved by incorporating a hinge system 82, which allows the push bar handle to be folded down after the pole 13 is removed for transportation. The push bar handle 80 is an improvement over disassembling and removing the push bar handle 80 for transportation. There are many hinge systems 82 that are known to those skilled in the art that can be incorporated with the push bar handle. The hinge system 82 is locked into place through the use of pins 84. In a preferred embodiment, two pins 84 are used but one skilled in the art may recognize only one pin is necessary. Moreover, in the preferred embodiment, cables 86 attach the pins 84 to the push bar handle 80.

The apparatus of the present invention are not confined to the embodiment described, but can be used on any agricultural machines to obtain the effects according to the invention. Other aspects, objects and advantages of the present invention can be obtained from a study of the drawings, the disclosure and the accompanying claims. The invention in its broader aspects is not limited to the specific steps and apparatus shown and described but departures may be made therefrom within the scope of the accompanying claims without departing from the principles of the invention and without sacrificing its chief advantages.

What is claimed is:

1. In a lighted traffic sign having a vented sign, a strobe light, a base, at least one wheel mounted to the base, and a pole mounted on the base supporting the sign, the improvement comprising inserts operatively connected to the vented sign such that each insert precludes sun light from passing directly through the vented sign and said inserts being in a fixed relation to said vented sign.

2. In a lighted traffic sign having a vented sign, a strobe light, a base, at least one wheel mounted to the base, and a pole mounted on the base supporting the sign, inserts operatively connected to the vented sign such that each insert precludes sun light from passing directly through the vented sign, the improvement comprising:

a liquid applicator operatively attached to the base for applying a liquid to the at least one wheel.

3. The liquid applicator of claim 2, further comprising:

a reservoir for storing the liquid;

an applicator pad for applying the liquid to the at least one wheel;

a line operatively connecting the reservoir and the applicator pad; and the line includes a valve for controlling the flow of the liquid to the applicator pad.

4. In a lighted traffic sign having a vented sign, a strobe light, a base, at least one wheel mounted to the base, and a pole mounted on the base supporting the sign, inserts operatively connected to the vented sign such that each insert precludes sun light from passing directly through the vented sign, the improvement comprising:

a portable restroom facility operatively attached to the base.

5. The portable restroom facility of claim 4 comprising:

a urinal for receiving urine;

the urinal operatively attached to an extension device;

the extension device operatively attached to a swivel;

the swivel includes an axle;

the extension device and the urinal pivot about the axle; and the swivel and the extension device are operatively attached to the base.

6. The portable restroom facility of claim 5, further comprising:

a waste tank;

the waste tank removably connected to the base;

a tube for operatively connecting the waste tank to the urinal; and the tube operatively connected to the extension device.

7. The improvement of claim 4, further comprising:

a restroom enclosure operatively attached to the base.

8. The restroom enclosure of claim 7 comprising:

a curtain;

the curtain operatively attached to an extension frame;

the extension frame comprises arms operatively connected together by a plurality of pins; and the extension frame is operatively attached to a height adjustment device.

9. In a lighted traffic sign having a vented sign, a strobe light, a base, at least one wheel mounted to the base, and a pole mounted on the base supporting the sign, inserts operatively connected to the vented sign such that each insert precludes sun light from passing directly through the vented sign, the improvement comprising:

a portable seat for an operator to rest upon while controlling traffic via the lighted traffic sign.

10. The portable seat of claim 9 comprising:

a seat;

the seat operatively attached to a bar;

the bar includes a first set of holes for receiving a pin;

the bar connects with a lower bar;

the lower bar includes a second set of holes for receiving the pin;

the lower bar further includes a resilient means; and the lower bar includes a non-skid pad, whereby the bar and the lower bar connect in such a way that one of the holes from the first set of holes and one of the holes from the second set of holes both engage the pin.

11. The improvement of claim 1, further comprising:

a hinge system operatively connected to the base; and a push bar handle operatively connected to the hinge system, such that the push bar handle folds down.

12. The improvement of claim 2, further comprising:

a hinge system operatively connected to the base; and a push bar handle operatively connected to the hinge system, such that the push bar handle folds down.

13. The improvement of claim 12, further comprising:

a portable seat for an operator to rest upon while controlling traffic via the lighted traffic sign.

14. The improvement of claim 13, further comprising:

a portable restroom facility operatively attached to the base.

15. The improvement of claim 14, further comprising:

a restroom enclosure operatively attached to the base.

16. The improvement of claim 11, further comprising:

a portable seat for an operator to rest upon while controlling traffic via the lighted traffic sign.

17. The improvement of claim 16, further comprising:

a portable restroom facility operatively attached to the base.

18. The improvement of claim 17, further comprising:

a restroom enclosure operatively attached to the base.

19. The improvement of claim 2, further comprising:

a portable seat for an operator of the lighted traffic sign to rest upon.

20. The improvement of claim 19, further comprising:

a portable restroom facility.

21. The improvement of claim 20, further comprising:

a restroom enclosure operatively attached to the base.

22. The improvement of claim 12, further comprising:

a portable restroom facility operatively attached to the base.

23. The improvement of claim 22, further comprising:

a restroom enclosure operatively attached to the base.

24. The improvement of claim 9, further comprising:

a portable restroom facility operatively attached to the base.

25. The improvement of claim 22, further comprising:

a restroom enclosure operatively attached to the base.

26. The improvement of claim 11, further comprising:

at least one pin for locking the hinge system.

27. The improvement of claim 12, further comprising:

at least one pin for locking the hinge system.

28. The improvement of claim 2, further comprising:

a pump means operatively connected to the liquid applicator for applying the liquid to the at least one wheel.

29. The improvement of claim 12, further comprising:

a pump means operatively connected to the liquid applicator for applying the liquid to the at least one wheel.

* * * * *